US005167268A

United States Patent [19]

Mao

[11] Patent Number: 5,167,268

[45] Date of Patent: Dec. 1, 1992

[54] CURTAIN-ROPE SWITCH CONTROLLER

[75] Inventor: Chien-Kao Mao, Taipei, Taiwan

[73] Assignee: Gemini Mercantile Inc., Taipei, Taiwan

[21] Appl. No.: 791,515

[22] Filed: Nov. 14, 1991

[51] Int. Cl.[5] ..... E06B 9/38

[52] U.S. Cl. ..... 160/178.2; 188/65.1

[58] Field of Search ..... 160/166.1, 178.1, 178.2, 160/168.1, 176.1, 331, 319, 320, 321, 344, 345; 188/65.1, 65.2, 65.3, 65.4, 65.5; 24/115 R, 115 J, 115 G, 115 H, 116 H, 116 R, 122.6, 136 R

[56] References Cited

U.S. PATENT DOCUMENTS

| | | | |
|---|---|---|---|
| 3,050,803 | 8/1962 | Hulterstrum | 188/65.1 X |
| 3,123,182 | 3/1964 | Malone et al. | 188/65.1 |
| 3,633,646 | 1/1972 | Zilver | 160/178.2 X |
| 3,931,846 | 1/1976 | Zilver | 160/178.2 |
| 4,502,668 | 3/1985 | Dodge | 188/65.1 X |
| 4,813,469 | 3/1989 | Scott | 160/178.2 |
| 4,878,269 | 11/1989 | Anscher et al. | 24/115 G |

FOREIGN PATENT DOCUMENTS

| | | | |
|---|---|---|---|
| 1136461 | 9/1962 | Fed. Rep. of Germany | 160/178.2 |
| 1966483 | 3/1973 | Fed. Rep. of Germany | 160/178.2 |
| 3035027 | 4/1982 | Fed. Rep. of Germany | 160/178.2 |
| 3046002 | 7/1982 | Fed. Rep. of Germany | 160/178.2 |

*Primary Examiner*—David M. Purol

*Attorney, Agent, or Firm*—Jacobson, Price, Holman & Stern

[57] ABSTRACT

A curtain cord operator has a casing which is mounted on left-hand and right-hand runs of a curtain cord for use in drawing the curtain and a control lever enabling the operator to grip either one of the cords selectively depending on the position of the lever so that the operator can be used to pull down on the selected cord and open or close the curtain accordingly.

3 Claims, 3 Drawing Sheets

CURTAIN-ROPE SWITCH CONTROLLER

BACKGROUND OF THE INVENTION

The present invention relates to a curtain-cord operator and relates more particularly to a curtain cord operator which can be used so that a curtain control cord can be pulled to cause a curtain to be drawn sideways over a window in opposite directions respectively depending on the position of the switching lever thereof incorporated in the operator.

Commonly a curtain is controlled by a curtain control cord, hereinafter referred to in the alternative as a rope. Pulling a curtain control rope in one direction causes a curtain to close over a window or a door for protection or ornament; and pulling the control rope in the other direction causes the curtain to be drawn sideways to open the window or door. Since there is no indication for identifying which direction a curtain control rope shall be pulled to open or close a window, direction error problem happens frequently. Further, directly pulling a curtain control rope by the fingers may become laborious if the curtain is heavy.

These disadvantages make curtain control in satisfactory use.

SUMMARY OF THE INVENTION

The present invention has been accomplished to eliminate the aforesaid problems. It is therefore an object of the present invention to provide a curtain-rope cord operator which can be adjusted into alternate positions so that a curtain-rope can be pulled to cause a curtain to be opened or closed over a window according to the position of a switching lever. It is another object of the present invention to provide a curtain-rope operator which makes a curtain-rope more easy and comfortable to operate.

According to the present invention, there is provided a curtain-rope operator for controlling the pulling direction of a curtain control rope, and which is generally comprised of a casing covered with a bottom cap for holding a switching or control lever, a brake gear and two rollers. The lever has a toothed sliding slot into which a toothed gear shaft on the brake gear is engaged. The casing has a toothed block beneath the opening thereof, and two elongated grooves on the inner wall surface thereof at two opposite sides relative to the toothed block to receive opposite run of the curtain rope. On/Off marks are made on the casing for indicating the pulling direction of the curtain control rope. The switching lever is shifted to either the on or the off position, and then, the curtain-rope operator is pulled downwards causing the brake gear to move upwards along a toothed sliding slot on the switching lever so as to clamp one or other run of the curtain control rope in position so that the rope moves down with the operator; moving the curtain-rope switch controller upwards causes the brake gear to move downwards along the toothed sliding slot on the switching lever so as to release the curtain control rope.

DETAILED DESCRIPTION OF THE PREFERRED EMBODIMENT

Figure 1:
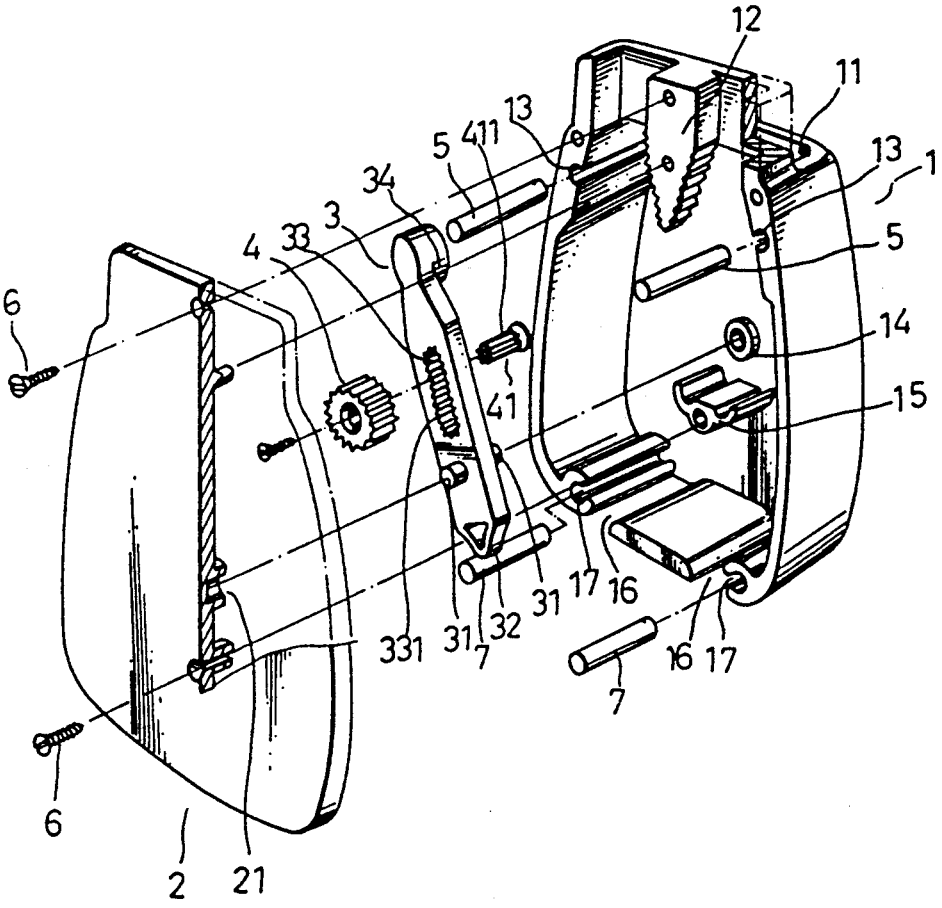
FIG. 1 is an exploded perspective view of a curtain-rope operator embodying the present invention.

Referring to FIG. 1, a curtain-rope operator as constructed in accordance with the present invention is generally comprised of a casing 1, a bottom cap 2, a switching or control lever 3, a brake gear 4, and pairs of rollers 5, 7. The casing 1 has a narrower top end extending from a wider bottom end, an opening 11 on the peripheral wall surface at the narrower top end thereof, a tapered, toothed block 12 disposed at the inside in parallel with the longitudinal axis thereof and adjacent to said opening 11, a first pair of elongated grooves 13 on the inner wall surface thereof at the top and at right angles relative to the longitudinal axis thereof, an axle seat 14 at the center, a double-seat locating plate 15 below said axle seat 14, two holes 16 on the bottom edge thereof for receiving opposite runs of a curtain rope, and a second pair of elongated grooves 17 on the inner wall surface thereof at the bottom at two opposite sides and at right angle relative to the longitudinal axis thereof. The bottom cap 2 is made in shape matching the casing 1, having an axle seat 21 at a location corresponding to the axle seat 14 in the casing 1. During assembly process, the bottom cap 2 is attached to the casing 1 by screws 6. The switching lever 3 is pivotably secured to the axle seats 14, 15 by an axle 31, having a resilient projection 32 at one end engaged in the double-seat locating plate 15, a sliding slot 33 longitudinally disposed at the middle which has teeth 331 on the inner wall surface thereof at two opposite sides, and a unitary hand-hold 34 at an opposite end. The brake gear 4 is made from metal material having a gear shaft 41 at the center inserted through the sliding slot 33 on the switching lever 3, which gear shaft 41 has teeth 411 on the outer wall surface thereof engaged with the teeth 331 in the sliding slot 33. The first pair of rollers 5 are respectively inserted into the first pair of elongated grooves 13 and the second rollers 7 are respectively inserted into the the second pair of elongated grooves 17.

Figure 2:
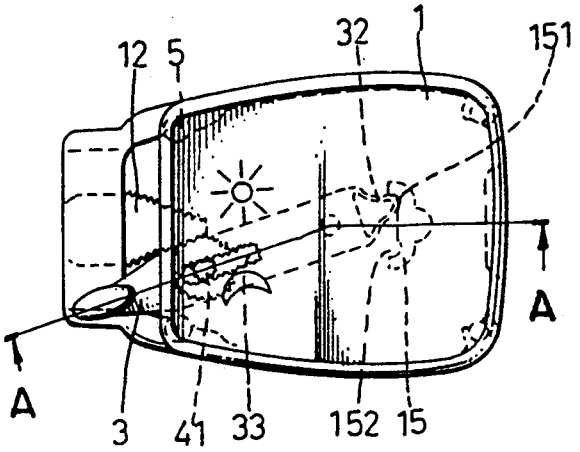
FIG. 2 is a top assembly view thereof.
Figure 3:
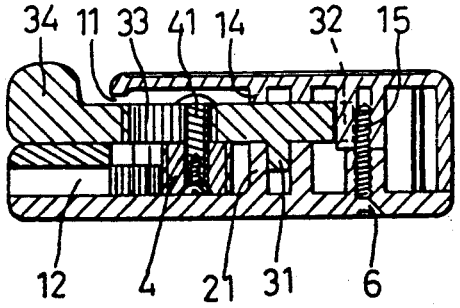
FIG. 3 is a cross sectional view taken on line A—A of FIG. 2.

Referring to FIGS. 2 and 3 and seeing FIG. 1 again, the assembly process of the present invention is outlined hereinafter. The first and second pairs of rollers 5, 7 are respectively inserted into the first and second pairs of elongated grooves 13, 17 and then, the axle 31 is fastened into the axle seat 14 with the resilient projection 32 alternatively engaged in either seat 151 or 152 on the double-seat locating plate 15, permitting the switching lever 3 to project through the opening 11 out of the casing 1. Then, the gear shaft 41 of the brake gear 4 is inserted through the sliding slot 33. Finally, the bottom cap 2 is secured on the casing 1 with the axle seat 15 thereof mounted on the axle 31 and then, fixedly secured in place by screws 6.

Figure 4:
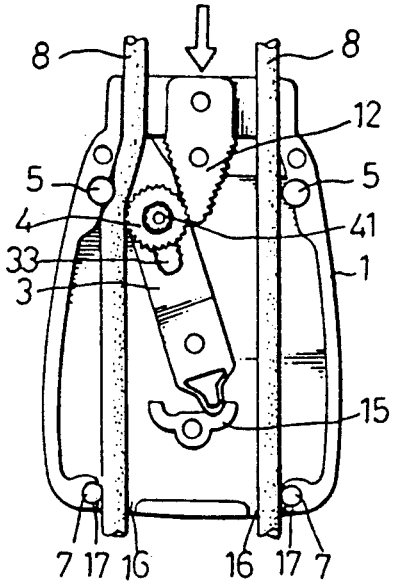
FIG. 4 is a schematic plan view showing the brake gear moved upward to engage with the toothed block so as to retain the curtain-rope in position.
Figure 5:
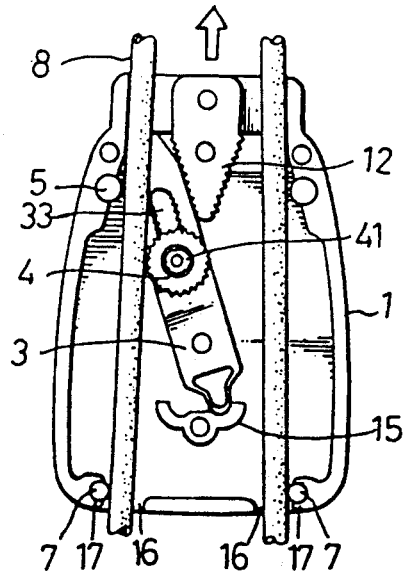
FIG. 5 is another schematic plan view showing the brake gear moved downward and disengaged from the toothed block permitting the curtain-rope to be released from constraint.

Referring to FIGS. 4 and 5 and seeing FIG. 2 again, the curtain-rope operator is fastened in a curtain-rod at the bottom of a curtain-rope 8 which is controlled to cause a curtain to be drawn sideways to open or to use over a window. During installation, the two opposite ends or runs of the curtain-rope 8 are respectively inserted from the opening 11 through the gaps between the brake gear 4 and the first two rollers 5 and the two notches 16. "ON" and "OFF" marks are made on the casing 1 for indication. When the hand-hold 34 of the switching lever 3 is shifted to "ON" or "OFF" position, the brake gear 4 is moved leftward (or rightward) toward the left hand or right hand run of the curtain-rope 8 FIGS. 4 and 5 show the lever in the leftward "ON" position. Pulling the curtain-rope switch controller downward causes the brake gear 4 to slide upwards in the sliding slot 33 of the switching lever 3, by means of the engagement of the teeth 411 on the gear shaft 41 to engage with the teeth 311 in the sliding slot 33, to further engage with the toothed block 12 in the casing 1, and therefore, the left hand run of the rope 8 becomes firmly retained between the left-sided roller 5 and the brake gear 4 (see FIG. 4). Thus, when the controller is pulled down, the left hand run of the rope 8 will be pulled down as well. When the curtain-rope switch controller is moved upwards from its bottom limit position, the brake gear 4 will be caused to move downwards along the sliding slot 33, by means of the friction force against the curtain-rope 8 and the rotary motion of the rollers 5 so as to release the curtain-rope 8 from the constraint (see FIG. 5). Similarly, when the lever 3 is moved to the right hand, "OFF" position it can be used to grip and release the right hand run of rope 8.

As indicated, the present invention provides a curtain-rope operator which helps a person to easily identify the correct direction in pulling a curtain-rope. Further, the specially designed shape of the casing makes the controller more practical for a comfortable and positive grip of the rope.

What is claimed is:

1. A curtain cord operator comprising a casing, passages in the casing for left-hand and right-hand runs of a curtain cord to pass through, a wedge-shaped block in the casing between said passages, gear teeth formed on opposite inclined sides of said block, a control lever pivotally mounted in the casing, the lever having a manually operable portion outside the casing, an elongate slot formed in the lever, further gear teeth formed on a side wall of the slot, a pinion received in said slot in mesh with said further gear teeth, and a gear wheel carried by said pinion, the lever having a first pivotal position in said casing wherein the gear wheel is adapted to mesh with the gear teeth on one inclined side of said block when the pinion is moved up said slot by downward movement of the operator so as to grip the left-hand run of the cord between the gear wheel and a left-hand internal part of the casing and wherein, in said first position of the lever, the pinion is adapted to move down said slot bringing the gear wheel out of mesh with the gear teeth on said one inclined side of said block when the operator is moved upwardly, so as to release the left hand run of the cord, the lever having a second pivotal position in the casing wherein the gear wheel is adapted to mesh with gear teeth on the opposite inclined side of said block when the pinion is moved up said slot by downward movement of the operator so as to grip the right-hand run of the cord between the gear wheel and a right-hand internal part of the casing and wherein, in said second position of the lever, the pinion is adapted to move down said slot bringing the gear wheel out of mesh with the gear teeth on said other inclined side of the block when the operator is moved upwardly so as to release the right-hand run of the cord.

2. A curtain cord operator as claimed in claim 1 wherein the casing includes cord-engaging rollers adjacent said passages.

3. A curtain cord operator as claimed in claim 1 wherein said lever is pivotally mounted in the casing adjacent one end of the lever and the casing includes a plate with left-hand and right-hand seats for receiving said one end of the lever in said second and first pivotal positions of the lever respectively.

* * * * *